US009105191B2

(12) United States Patent
Jenkins et al.

(10) Patent No.: US 9,105,191 B2
(45) Date of Patent: Aug. 11, 2015

(54) GROUP MONITORING AND COLLISION AVOIDANCE SYSTEM AND METHOD WHICH IS MOUNTED ON A VEHICLE

(71) Applicant: SR Products Inc., Homosassa, FL (US)

(72) Inventors: Nevin C. Jenkins, Homosassa, FL (US); Rande Newberry, Cocoa, FL (US)

(73) Assignee: SR PRODUCTS INC., Homosassa, FL (US)

( * ) Notice: Subject to any disclaimer, the term of this patent is extended or adjusted under 35 U.S.C. 154(b) by 177 days.

(21) Appl. No.: 13/793,888

(22) Filed: Mar. 11, 2013

(65) Prior Publication Data

US 2013/0300581 A1 Nov. 14, 2013

Related U.S. Application Data

(60) Provisional application No. 61/646,006, filed on May 11, 2012.

(51) Int. Cl.

| | |
|---|---|
| ***G08B 21/00*** | (2006.01) |
| ***G08G 1/16*** | (2006.01) |
| ***G08G 1/00*** | (2006.01) |
| ***G08G 9/02*** | (2006.01) |

(52) U.S. Cl.

CPC ..... *G08G 1/166* (2013.01); *G08G 1/163* (2013.01); *G08G 1/20* (2013.01); *G08G 9/02* (2013.01)

(58) Field of Classification Search

USPC ..... 340/435, 436, 902, 903; 701/301

See application file for complete search history.

(56) References Cited

U.S. PATENT DOCUMENTS 8,352,112 B2 * 1/2013 Mudalige ..... 701/24

* cited by examiner

*Primary Examiner* — Jeffery Hofsass

(74) *Attorney, Agent, or Firm* — Fleit Gibbons Gutman Bongini & Bianco PL; Martin Fleit; Paul D. Bianco

(57) ABSTRACT

A group or solo monitoring system and method for collision avoidance that uses a transceiver circuitry mounted on a vehicle. The circuitry can include a microprocessor, a memory having stored therein non-transitory instructions for programming the microprocessor, a visual indicator, an audio indicator, a user interface including a display screen and navigation buttons, an RF transceiver with antenna, and a power supply. Non-transitory instructions stored in memory configure and control the microprocessor to enable a user to enter data into the memory via the user interface via the display screen and navigation buttons. A vehicle group can be formed and a proximity perimeter created about the group. Visual and audio alerts are issued to avoid a collision in the event that a non-group vehicle has been detected as having penetrated the proximity perimeter and is closing in on at least one vehicle of the group.

14 Claims, 9 Drawing Sheets

GROUP MONITORING AND COLLISION AVOIDANCE SYSTEM AND METHOD WHICH IS MOUNTED ON A VEHICLE

CROSS REFERENCE TO RELATED APPLICATION

This application is related to and claims priority from U.S. Provisional Application No. 61/646,006 filed on May 11, 2012, herein incorporated by reference in its entirety.

BACKGROUND

There is a need for a monitoring and collision avoidance system for groups of vehicles travelling together, as in convoy, with respect to encountering individual or similar groups of vehicles, to avoid collisions. For example, a group of snowmobiles or other such vehicles travelling over unmarked terrain are in danger of meeting a similar group of snowmobiles, particularly at blind corners.

SUMMARY OF THE INVENTION

A system is provided comprised of transceivers with appropriate control circuitry intended for use on vehicles that communicate between themselves to create a proximity perimeter for the purpose of collision avoidance and group monitoring. The transceivers can alert users when other transceivers are within certain proximities. There are 2 main functions of the system, (1) as a warning when transceivers are closing in on each other to avoid a collision, and (2) forming a unique group that learns each other transceivers that can insure group integrity by way of alert(s) when a group member(s) fall(s) outside the proximity perimeter. The invention further includes a method to locate group member(s) that are not within a defined perimeter.

DETAILED DESCRIPTION OF PREFERRED EMBODIMENTS OF THE INVENTION

The system incorporates RF signal strength detecting algorithms and can include known GPS coordinate processing to define the proximity perimeters. The GPS, together with an optional eCompass can also provide directional information for both collision avoidance and member tracking.

Figure 2:
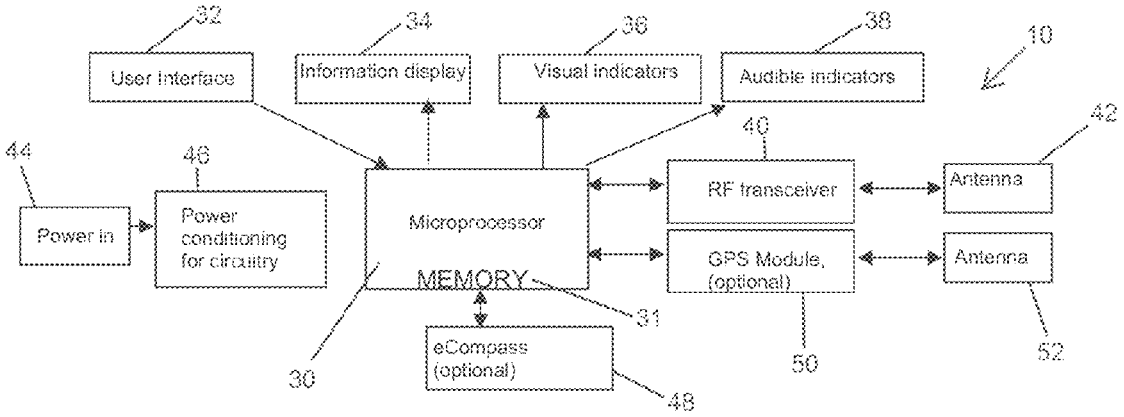
FIG. 2 is a block diagram of the electronic circuitry in an appropriate enclosure (referenced as the transceiver as a whole) mounted on, or otherwise attached to each vehicle of a group of vehicles.

The Term "Transceiver" as used herein refers to the product as a whole, which includes the components described in FIG. 2.

Applications

Examples

Collision avoidance. Snowmobile accidents are often caused by collisions due to limited visibility conditions from weather and obstructions, especially on curves where head on collisions can occur. The system would alert the users in one group of the proximity of other groups of users thereby alerting them of a potential collision. Note also that the system could apply to a single user, not necessarily in a "group".

Group member tracking. Members within a specific group can be alerted when other member(s) have moved out of a defined or specified proximity, indicating they may have broke down, got lost or had an accident. The system allows for users notification that a "lost" member has moved back within the specified proximity and also for being able to track the location of the lost member if the need arises.

The example application of the invention can be applied to a host of other monitoring and collision avoidance warning system for off road vehicles, such as, motorcycles and dunebuggies and watercraft as well.

Figure 1A:
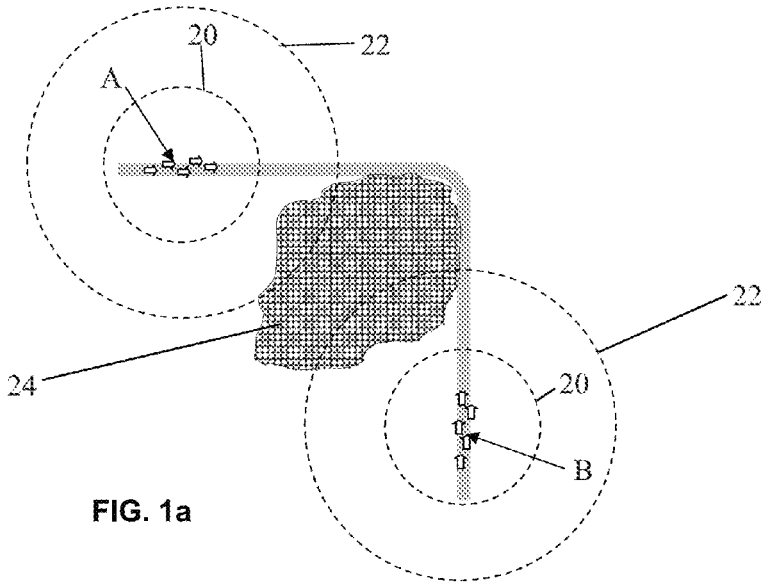
FIGS. 1*a* and 1*b* are schematic diagrams illustrating pictorially how the system functions when two groups (A and B) are approaching a "blind" corner or an intersection in a path or trail.
Figure 1B:
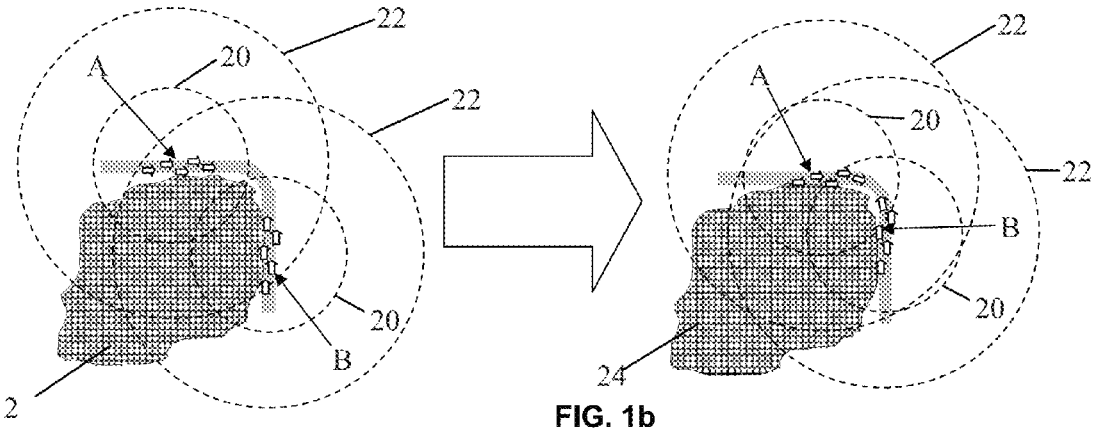
Figure 11:
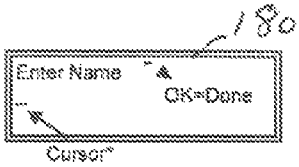
FIG. 11 shows schematically the enter name screen 180 on the display 64, which can be changed using the up down nav keys 151, 152 to select letters, which will show up at the cursor position. The up key 151 displays the next letter (from A through Z) at the cursor position. The down key 152 moves backward through the alpha characters from Z to A.
Figure 12:
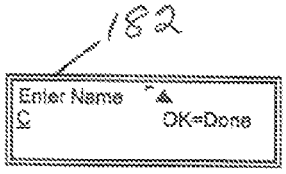
FIG. 12 shows schematically the up key 151 pressed three times to display C at the cursor position screen 182, whereupon the right nav key 153 moves the cursor for the next letter and the left nav key enables moving the cursor backward for edits.
Figure 13:
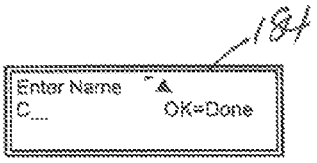
FIG. 13 shows schematically the cursor moved for the next letter screen 184.
Figure 14:
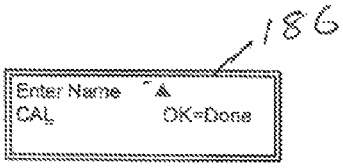
FIG. 14 shows schematically screen 186 showing a completed name following the procedure noted above.
Figure 15:
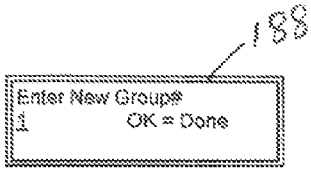
FIG. 15 shows schematically that the OK button 155 has been pressed to get to the next display screen 188 where a group number is entered by using the up down nav keys 151, 152 to select numbers, which will show up at the cursor position, the up key 151 displays the next number (1, 2, 3, etc. to 0) at the cursor position. The down key 152 moves backward through the numbers (0, 9, 8 etc.)
Figure 16:
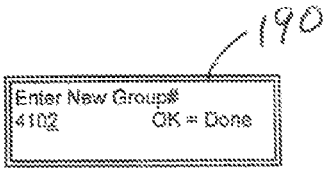
FIG. 16 shows schematically an example of selecting the group number. The up key 151 has been pressed four times to display 4 and the right key 153 has been pressed to move the cursor to the next position and the up and down keys 151, 152 have been pressed to select the next number and the procedure repeated until the display screen displays the correct group number, as for example shown in screen 190.
Figure 17:
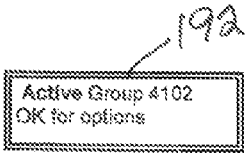
FIG. 17 shows the display screen 192, which has come up in response to the OK button 155 having been pressed, after which the transceiver will store the information and then go to the normal monitoring mode using this information. Note: The cursor can be a different type of indicator, such as a highlighted character position.

A pictorial schematic diagram of how the system is utilized to avoid a collision is shown in FIGS. 1*a* and 1*b*. As shown, two groups (A and B) are approaching a "blind" corner (or an intersection) in a path or trail and cannot see one another. As shown in 11*a* the two groups A and B are approaching each other from opposite sides of a blind corner 24. Each group is emitting a defined close proximity perimeter of detection area 20 and an outer proximity perimeter of detection area 22. As shown in FIG. 11*a*, there is no conflict between the proximity perimeters of one group with respect to the other. As the groups approach the blind corner 24, proximity Alerts of various preselected intensities can be given when the groups' outside perimeter area 22 is entered by the other group (is in conflict). The intensity of each Alert given is proportional to how close the groups are getting to each other. This is depicted in FIG. 11*b* on the left side of the diagram. As the Groups A and b move to a potential collision at the blind corner 24 on the right side of FIG. 11*b*, an Alarm warning initiates when group members of groups A and B enter into conflict of the close proximity perimeter of the detection areas 20.

As noted above, the system hardware is made up of electronic circuitry in an appropriate enclosure (referenced as the transceiver 10 as a whole) mounted on, or otherwise attached to a vehicle. A block diagram of the electronic circuitry and its functions are shown in FIG. 2. The circuitry consists of a microprocessor 30 containing a memory 31 containing non-transitory instructions for programming the microprocessor 30 with the appropriate algorithms and instructions for carrying out steps to achieve the desire functions as specified herein. Connected to the microprocessor 30 are a user interface 32, an information display 34, visual indicators 36 and audible indicators 38. Also connected to the microprocessor 30 is an RF transceiver 40 connected in turn to its antenna 42. Power is provided by batteries situated in the power in block 44, connected to suitable power conditioning circuitry 46 connected in turn to all circuitry requiring power. An eCompass 48 is connected to the microprocessor 30, and a GPS module 50 is also connected to the microprocessor 30. Module 50 is connected to its antenna 52.

Power in 44 provides power to operate the circuitry of FIG. 2 and typically 12VDC is used to operate the circuitry. The power may be derived from the vehicles power system, in which case, power will be supplied to the Transceiver 10 when the vehicle's power switch is turned on.

Power in, with suitable on-off control, may alternately be supplied by batteries or any other 12VDC source. Power Conditioning for Circuitry 46 provides the Circuitry that converts the vehicles power into a useable voltage for powering the circuitry. Microprocessor 30 contains an imbedded memory 31 and controller that contains non-transitory instructions to carry out a program that communicates with the user interface to set up and implement user inputs, such as, defining a group and other functions that will become apparent hereafter. The Microprocessor 30 is controlled by further non-transitory instructions to command and receive data to and from the RF transceiver 40 to determine the status of other transceivers within the proximity area of detection and to provide user with an indication of status via the Visual 36 and/or audio 38 indicators on the User Interface 32. User Interface 32 includes a keyboard or other user input mechanism that allows a user to teach or instruct the microprocessor 30 to perform its functions in a specific way. Information display 34 includes an electronic display of LED, or LCD, or other type that displays to the users various information. Visual indicators 36 provide lights or other type visual aids that inform the user of the proximity of other group members (i.e. tracking lost member) and non-group members (i.e. proximity warnings and alarms). Audio indicators 38 provide beeps or other forms of audible sound that inform the user of the proximity of other group members and non-group members. RF Transceiver 40 includes an RF Transmitter and RF receiver operating in an agency approved frequency band. The transmitter 40, via its antenna 42, sends "beacon" signals on a timed basis that other transceivers located in other vehicles receive. The Receiver, via antenna 42, accepts signals transmitted from other transceivers located in other vehicles, and determines signal strength of that received signal and reports this information to the microprocessor 30. GPS Module 50 is a known device that receives signals via its antenna 52 from multiple satellites and can calculate its geographic position. The GPS module 50 is an optional accessory. Antennas 42 and 52 are devices that are used to efficiently emit and collect the RF or microwave energy. eCompass 48 is a known electronic device that can provide digital compass data. The eCompass 48 is an optional accessory.

The method of implementation of the Firmware will now be described. Firmware is the instruction set stored in memory together with other non-transitory instructions stored in memory for programming the microprocessor to perform the functions and steps herein described. The principal functional description of the firmware follows.

A: Range or Distance estimates—Each transceiver (FIG. 2) transmits a beacon signal at set intervals which contains information identifying the specific transmitting transceiver. All other transceivers located on other vehicles receive these beacons and process each signal to determine: 1) whether beacon is originated by a Group member or foreign vehicle; and 2) the power of the received beacon. Using this information, the transceiver estimates the relative distance of each received beacon and provides the user associated with that transceiver with warnings and alerts with respect to foreign transceivers, and/or tracking information with respect to locating a member. If the transceiver includes a GPS module 50, it can provide better distance estimates between transceivers by calculating the geographic coordinate differences. If the transceiver includes an eCompass 48, it can provide directional information of the relative geographic coordinates between transceivers.

B: Group members—User interface 32 provides for specific transceivers to "join in a group". The group would typically be a set of users on vehicles that want to stay together. Once joined, the transceivers of the group members would not initiate any alert or other notification when the group members are in proximity with respect to a specifically defined or preselected outer perimeter 22. But, if a group member (or several group members) falls out of that perimeter, the member(s) becomes lost member(s), and a unique visual 36 indicator and/or a unique audible 38 indicator lets or informs other group members still within the perimeter that one or more members have moved outside of the perimeter 22. If the lost member(s) re-enters the outside perimeter 22, the other members are notified by a unique visual 36 and/or a unique audible 38 indicator and the transceivers will resume normal operation. If the group members want to locate a lost member, they can enable a search feature of the transceiver 10 that allows them to track to the location of the lost member through a visual indication 36 of the signal strength of the beacon being transmitted via antenna 52 of the lost member.

C: Non-Group members (i.e.: foreign transceiver)—Any Transceiver mounted on a vehicle that is not a part of your defined group is termed a "foreign transceiver". A vehicle, not part of your group having a foreign transceiver mounted thereon or not, will cause an alert to be initiated, when that vehicle is within the outer 22 and/or inner 20 perimeters of your group. And likewise, any foreign transceiver mounted on a vehicle not part of your group will cause an alert to your group when they are within the outer 22 and/or inner 20 perimeters.

D: Alerts and Alarm warnings: The signals provided by alert indicators (audio 38 and/or visual 36) can change based on data received by a Transceiver 10 via the controller in the microprocessor 30 and/or by a Group member via its user interface 32. For example, a non-member entering the outer perimeter 22 may be a blinking yellow light, and/or short intermittent beep. If the non-member moves to within the close proximity area 20 the light may flash rapid and bright, be red in color, or other visual indicator 36 indicating a high alert condition. The Audio 38 may follow this same procedure . . . low volume beeps to high intensity sounds depending on the determined proximity of a foreign transceiver. In addition, a user may select to only display a warning when a foreign enters the inner proximity 20 (i.e. do not indicate an outer perimeter 22 breach).

E: User interface functions: —User interface 32 and the information display on the interface 32 provide a method to allow each user to set up or program the user's transceiver. The following items are options included in the user interface.

Define a Group.

Various methods can be implemented to do this function. The object is for all transceivers in a specific group to learn all other members in that group and only those members. Considering that that there may be other groups within the range of the transceivers that may be forming their own unique group at the same time, the Transceivers 10 will have a method to ensure only the intended members of a group can join that group. One such method would be to inform the members of a group an assigned group number (or the group members can decide on any group number). Once decided, then each member of the group would enter that group number in their transceiver as the identifier of the group. The Transceivers 10 will then communicate with each other thus teaching all members that have entered the group the number of the group, and the information with respect to group number and members of the group will be stored in memory of the microprocessor 30 of each transceiver. Additional information that can be useful with the feature of locating a lost member, such as a user's name, can be included and stored when defining a group.

Example

The group members are issued, or decide on group #1234. Each group member programs the member's transceiver (microprocessor) to enter the group number in memory via the group learn mode, and then enters the group number through the use of the user interface 32. As other group members follow this procedure, their transceivers recognize other transceivers that have joined and displays these through the information display, there by letting all group members know the quantity of joined members, as well as other "joined member" information that may be useful. One such embodiment of this user function is detailed in the Program function block diagrams section below which describes the various routines and subroutines.

Add a Member to a Group:

The transceivers will have a method to add a group member after the initial Group has been established. One method to do this would be to provide the new member with the group number, which they would add to their transceiver, all other transceivers in that group would now recognize that new transceiver as being in the group. One such embodiment of this user function is detailed in the Program function block diagrams section below.

Locate a Lost Member of a Group:

The transceivers will have a method whereby the range of the system can be extended beyond the outer perimeter as defined above that can be utilized to "track down" the lost member when needed. One such embodiment of this user function is detailed in the Program function block diagrams section below.

Ignore Function:

The transceivers will have a method to ignore foreign transceivers, i.e. not activating the Status display. One such embodiment of this is to include a single button the user presses. The program will ignore all foreign transceivers currently within range and not display alerts or warnings. One such method would be to activate the ignore function for a specific time period and automatically re-enable normal monitoring when that time period has elapsed. For example, one press for 1 minute, two presses for 2 minutes and so forth. Another method to automatically re-enable from an ignore condition can be if the foreign transceiver moves out of the outer perimeter, the transceiver that was in ignore mode will clear the ignore, so if the foreign transceiver re-enters the set perimeter the alert/warnings will activate.

Range Limit Function:

The transceivers will have a method to limit the status display to alerting/alarming only on user selectable range(s). One such embodiment is a user selectable item shown in the Program function block diagrams section below.

Auto Dimming the Status Display:

The transceivers will have a method to auto dim the status display at night.

Figure 3:
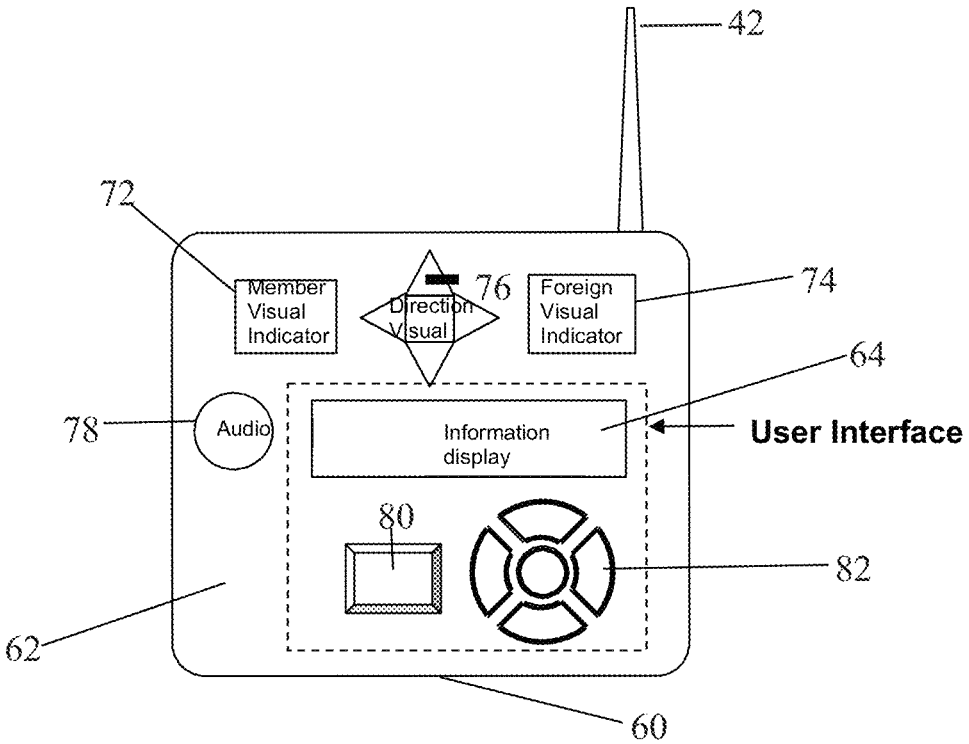
FIG. 3 is a schematic diagram illustrating the enclosure of the circuitry of FIG. 2 and in particular showing the User Interface.

The User Display 32 is shown in FIG. 3 and consists of one face 62 of a box 60 that houses the Transceiver 10. Provided on face 62 is information screen or display 64 which provides e.g. 2 lines of 16 characters per line. Above the display 64 is a Member Visual Indicator 72, a Foreign Visual Indicator 74, and between them is a Direction Visual Indicator 76, which has arrows to show direction, such as, N, S, E and W. An Audio Alert and Indicator 78 is shown on the left side of the display 64. Below the display 64 is a Mute button 80 and Navigation Keys 82. The appropriate circuitry for the User display 32 is contained within the box 60 using printed circuit boards in a conventional manner.

The Member Visual indicator 72 is used to track a lost member. One embodiment of this is a series of lights horizontally (a light bar) indicating the proximity of the lost member. For example, a single light illuminated in the series would indicate the lost member is far away, When all lights in the series are illuminated that would indicate the lost member is very close. The Visual indicator 72 may be mounted separately from the user interface section of the Transceiver 10. The member visual indicator is also used to let all members know that a member has either left, and/or re-entered the outer detection perimeter, via lighting up the member visual area for a short time with various light colors and intensities. One embodiment of this is using the series of lights above to sequence the lights in a downward pattern (for a member leaving the outer perimeter) and alternately, the string of lights would sequence in an upward pattern to indicate a member returning within the outer perimeter. The Visual indicators may be mounted separately from the user interface section of the transceiver. The Direction Visual Indicator 76 is only implemented if the GPS and eCompass options are included. The function of indicator 78 would be to indicate the direction of the missing member. One embodiment would be a diamond shape where the points of the diamond would light up indicating the direction (N, S, E and W) to go to find the lost member. The Visual indicator 78 may be mounted separately from the user interface section 32 of the transceiver 10.

The Foreign member indicator 74 alerts the user to a Foreign transceiver within the outer and/or inner perimeters. One embodiment is that this indicator uses lights of different colors (for example, yellow lights indicate an outer perimeter breach, and red lights indicating breach of the inner perimeter). The Visual indicator 74 may be mounted separately from the user interface section 32 of the Transceiver 10.

The Audio indicator 78 is used as an alert for a user, if there are Foreign transceivers within the outer and/or inner perimeters. In addition, the Audio indicator 78 can be activated by another member seeking your transceiver that can assist in locating a lost member.

The Information display 64 is used by the user to get feedback to assist in entering configuration parameters (i.e. group number, name. etc.). One embodiment would be an LCD display with multiple lines of characters that can prompt the user for input of the parameters (for example, a 2 line×16 character display).

The Navigation keys 82 allow the user to enter configuration parameters or select the various options, such as, find a lost member, join a group, etc. One embodiment would be a set of 5 buttons in a nay-type configuration as depicted in FIG. 3 that allows the user to scroll left, right, up, and down and enter/select an option.

Figure 8:
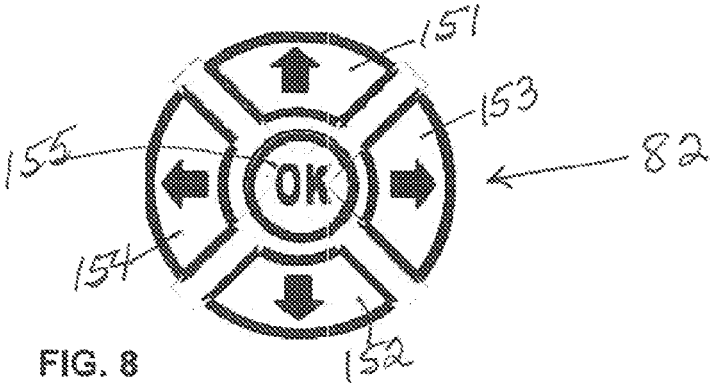
FIG. 8 shows schematically the navigation button 82 containing the up, down nav keys 151, 152; the right, left nav keys 153, 154 and the OK button 155.

The 5 button "navigation key" user interface 82 allows for inputting alpha and numeric information. The Nay keys allow the user to scroll through letters or numbers depending on which display screen is being displayed, move the cursor position for entering the next alpha or numeric character and accept the information entered. The 5 button "navigation key" user interface 82 is shown in FIG. 8. An example of using the Nay keys, along with the Information display is described in detail previously.

Figure 4:
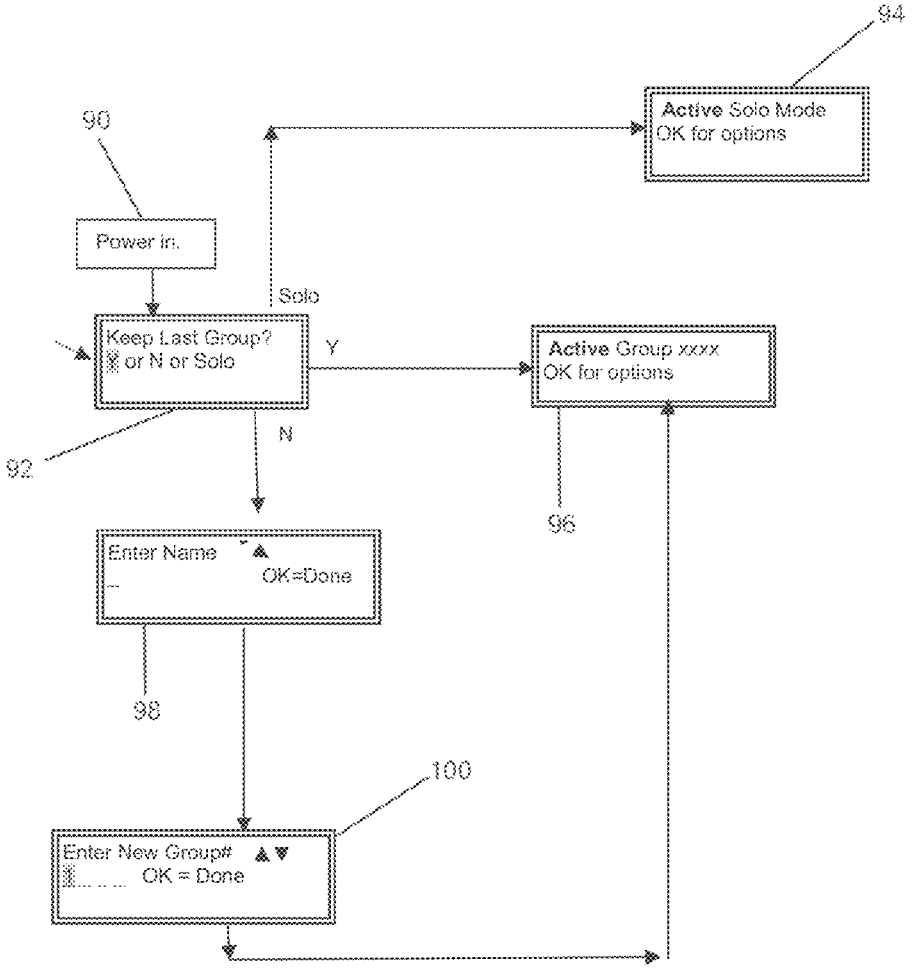
FIG. 4 shows schematically the program function block diagram (routine) for creating a group on power up.

The Program function block diagrams are shown in FIGS. 4-7 and will be described now. In FIG. 4 the Program function block diagram (routine) is for creating a group on power-up. On power up, the information display 64 prompts for selections as described below. The Status display 64 prompts the user to enter information, and also shows the system status. Power up occurs when the host power is turned on (turning on the ignition key), see block 90. The first display 64 is shown in block 92 and queries "Keep last group?" "Y or N or Solo". If there is no user interaction (i.e. no buttons are pressed) on power up, after 1 minute, the transceiver 10 will default to the last group it was a member of (same as selecting the Y option). The Visual indicator 72 may flash letting the user know the previous group information will be restored. If Y is selected, the last group info is retained in non-volatile memory and restored on a power up. If Solo is selected, the information display 64 appears as in block 94 "Active Solo Mode" and the transceiver is in the normal monitoring mode for a Solo person and "OK for options" signals for the OK button of the nav buttons 82 be pressed to advance the program. In the solo mode (ie a single individual) the transceiver is not a member of any group, and all other transceivers would be treated as a foreign transceiver. If Y is selected, the information display shows the legend of block 96 "Active Group xxxx" and "OK for options" signals that OK button of nav buttons 82 be pressed to advance the program. This is the information display when the transceiver is in the normal monitoring mode for a group member. If N is selected in block 92, the program for creating a group steps to block 98 where it commands "Enter Name" and "OK=Done" and when OK of the nav buttons 82 is pressed the program steps to block 100 where it commands "Enter New Group #" and provides 4 spaces to do so, which when filled, "OK=Done", the OK button of the nav buttons 82 is pressed to advance the program. If a Group number was previously entered, The Group number would default to the previous saved value.

Figure 5:
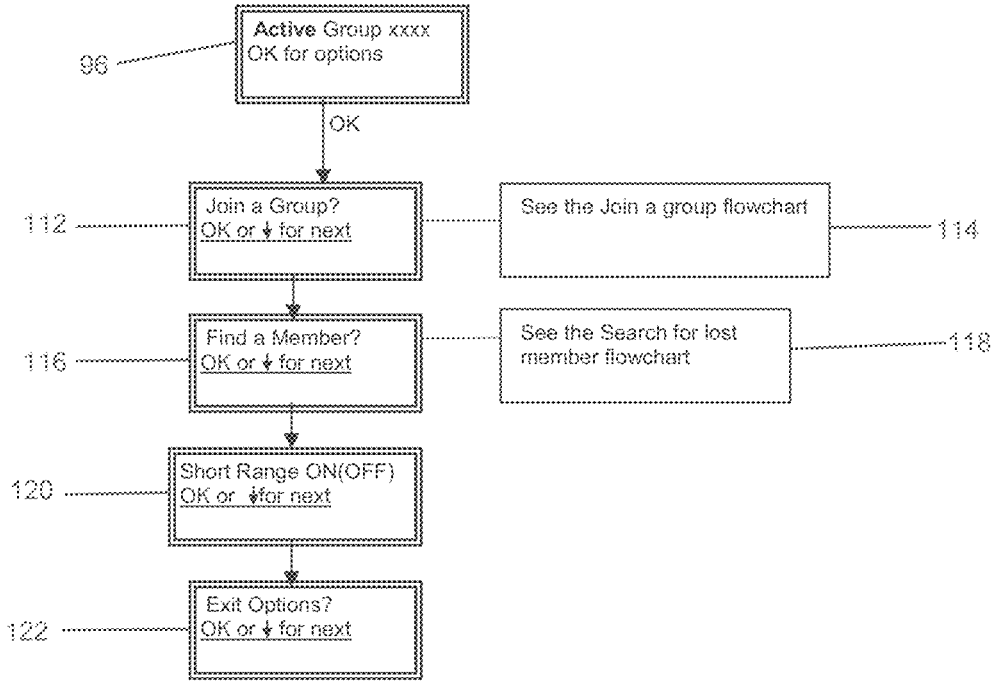
FIG. 5 shows schematically the program function block diagram (routine) for providing an Options Menu.

Referring now to FIG. 5, the Options Menu and program routine is shown. Once powered up and the group (or solo) is established, the following options are selectable by pressing the OK button of nav buttons 82 from the Active monitoring screen is being displayed in block 96 of FIG. 4. Press the OK key when this screen 64 is showing (the Active monitoring status screen, Group #) to bring up the options. The first option to appear is to join an existing group? in block 112 which is described hereinafter in the Join a Group flowchart. To join an existing Group, the OK button of buttons 82 is pressed and the program branches to Join a Group flowchart see block 114. Otherwise, DOWN is selected by pressing the down button on the nav keys 82 to bring up the next option of Find a Member? in block 116. This option can be selected by pressing the OK button on the nav keys 82, in which event, the program branches to the Find a lost Member flowchart, see block 118. Otherwise the DOWN key of the nav keys is pressed to bring up the next option of Short Range ON (OFF) in block 120. Pressing OK toggles between the text ON and OFF being displayed in the screen 64. For Short range ON selected, when the DOWN key is pressed, only the inner perimeter is active (i.e. no warnings or alerts when a foreign transceiver breaches the outer perimeter). Pressing the OK button goes back to active monitoring with the "range" setting selected above. Pressing the DOWN key advances the program to block 122 to the query "Exit Options?". Pressing the DOWN key returns the program back to block 112 to repeat the Options menu, starting with the "Join a group?" option above.

Figure 6:
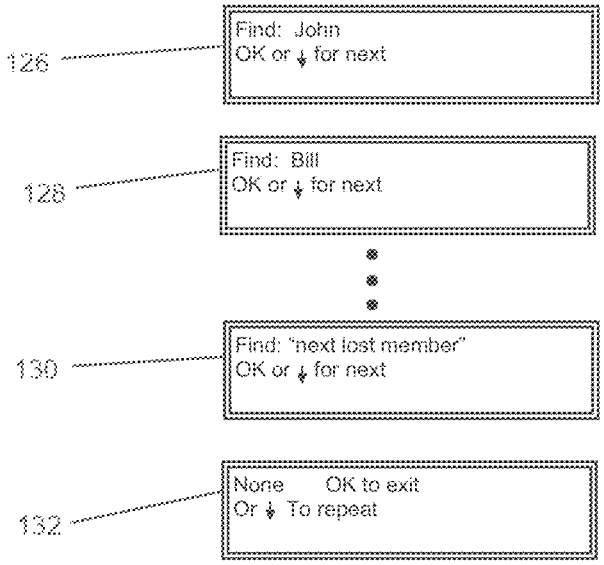
FIG. 6 shows schematically the program function block diagram (routine) for finding a lost member of the group.

Referring to FIG. 6, the Find a Member subroutine is activated and the screen 64 shows the legend that appears in block 126. A user can scroll through the list of group members and select to search for a particular member. All group members will be on the list and can be searched for. If there is/are member(s) that are outside the perimeter, they will be marked as such in the display (i.e. an X or other symbol next to their name).

When a user selects to locate or find a member, the user's transceiver 10 uses the member visual indicator 72 section of the Status display to indicate the proximity of the member being tracked.

Figure 9:
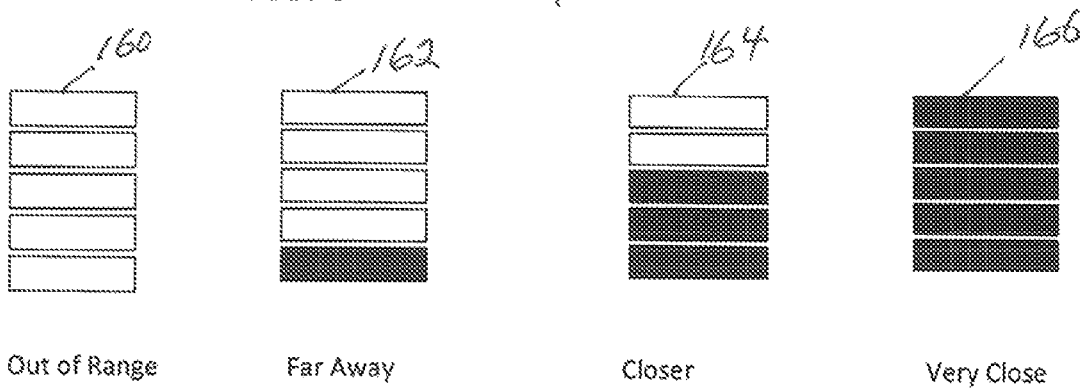
FIG. 9 shows schematically the bar codes 160-165 for showing relatively proximity.
Figure 10:
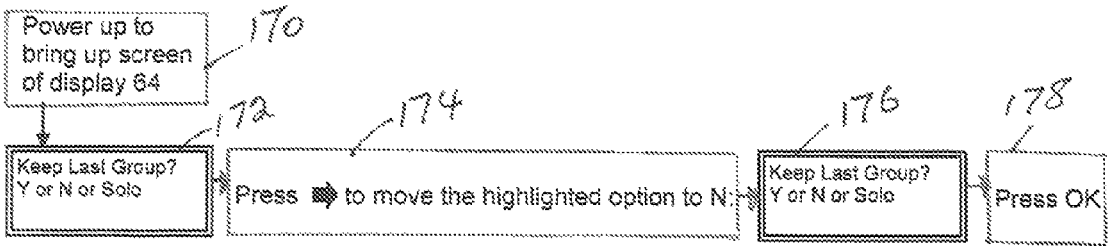
FIG. 10 shows schematically a specific example of key entry, in step 170 the apparatus is powered up to bring up screen 172 of display 64, then the fight arrow 153 is pressed to move the highlighted option to N to change the display to screen 176, and then the OK button is pressed.

For reference design, there are 5 levels of proximity shown by a "bar graph" type LED display where one short bar is far away and full bars is close proximity, as shown to the right of FIG. 9. Note that the Audio indicator 78 may be utilized to assist in searching, such as, for example, short beeps could mean far away, long beeps could indicate close proximity. NOTE: If there is no user interaction (i.e. no buttons are pressed) after 1 minute, the transceiver will default to the last group it was a member of.

When Find a Member is selected from the options, the screen 64 that appears in block 126 shows "Find: John". John, in the example, is a member of the current group number. Selecting OK for John activates the "search function" of the transceiver, wherein John's Transceiver "Pings" are detected, and the relative power level of that transceiver's pings are displayed through the member status display as illustrated and discussed above. In addition, when the search for John's transceiver is being carried out, the audio indicator 78 in John's transceiver can be automatically turned on (i.e. loud beeps) that can provide additional assistance in locating John. Selecting DOWN will display the next member in the current group, i.e. Bill, as shown in block 128, who can be selected to be searched for, and so forth in block 130 and onward until block 132 is displayed on the screen indicating that all members have been accounted for. When the list of all group members is completed, as shown in block 132, the selection to exit the search option or repeat the list is provided. Selecting OK returns to the Active monitoring mode, the main routine. Selecting DOWN loops the subroutine back to its beginning and the subroutine repeats the list of members so a member can be selected to be searched for.

Figure 7:
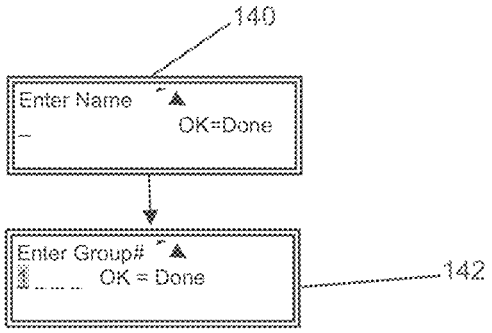
FIG. 7 shows schematically the program function block diagram (routine) for adding a member to an existing group.

The subroutine for Joining a Group, that is, to an existing group is shown in FIG. 7. In general, to join an existing group (which is defined by the group number), a user would enter their name, and the group number through the user interface as described below. NOTE: If there is no user interaction (i.e. no buttons are pressed) after 1 minute, the transceiver will default to the last group it was a member of. The screen 64 appears is shown in block 140 when the Join a Group option (subroutine) is selected from the Options menu FIG. 5, see block 96 (or 94). The Nav keys 82 are used to enter a name on the screen 64 in block 140. OK is pressed when done and the subroutine advances to the screen 64 shown in block 142. If no action is taken, the name would default to the previous saved value, if one was previously entered. The Nav keys 82 are used to enter a group number, and OK is pressed when done to return to the Active monitoring mode main routine wherein the screen 64 shows as in block 96 or 94, as appropriate. The Group number will default to the previous saved value, if one was previously entered.

A specific example of key entry using the nav key buttons 82 for inputting a name and group number starting from power up, is shown in the blocks of screen shots of display 64 shown in FIGS. 10 to 16

The Mute button 80 is used to temporarily disable the audio indicator 78 and Visual indicators 72 and 74 with automatic return of functionality. One method to accomplish this is to enable a specific time for each press of the button (such as, 1 minute for 1 press, 2 minutes for 2 presses, etc.).

Although the invention has been described in specific embodiments, changes and modifications will be evident to persons skilled in the art, which do not depart from the spirit and scope of the teachings herein. Such changes are deemed to fall within the purview of the invention as claimed.

What is claimed is:

1. Group monitoring and collision avoidance system for mounting on a vehicle comprising transceiver circuitry including a microprocessor, a memory having stored therein non-transitory instructions for programming the microprocessor, a visual indicator, an audio indicator, a user interface including a display screen and navigation buttons, an RF transceiver with antenna, and a power supply; said transceiver circuitry configured and controlled by the non-transitory instructions stored in memory to enable a user of the transceiver to enter data into the memory by interacting with the user interface via the display screen and the navigation buttons, to enable the transceiver to communicate with other like transceivers mounted on similar vehicles to form a vehicle group, to establish and monitor a proximity perimeter about the formed group of vehicles as the vehicles and their users travel, for group monitoring and for initiating visual and audio alerts to avoid a collision in the event that a non-group vehicle has been detected as having penetrated the proximity perimeter and is closing in on at least one vehicle of the group.

2. The group monitoring and collision avoidance system according to claim 1 wherein group monitoring includes detecting that a member of the group has passed beyond the proximity perimeter, and providing a visual alert to the remaining group members still within the proximity perimeter.

3. The group monitoring and collision avoidance system according to claim 2 wherein the provided visual alert is indicative of the distance the member of the group has passed beyond the proximity perimeter.

4. The group monitoring and collision avoidance system according to claim 3 wherein the provided visual alert also is indicative of the direction the member of the group that has passed beyond the proximity perimeter relative to the remaining group members still within the proximity perimeter.

5. The group monitoring and collision avoidance system according to claim 3 wherein the provided visual alert also is indicative of the GPS location of the member of the group that has passed beyond the proximity perimeter relative to the remaining group members still within the proximity perimeter.

6. The group monitoring and collision avoidance system according to claim 1 wherein said transceiver circuitry is further configured and controlled by the non-transitory instructions stored in memory to establish and monitor an inner proximity perimeter about the formed group of vehicles as the vehicles and their users travel and an outer proximity perimeter about the formed group of vehicles as the vehicles and their users travel.

7. Group monitoring and collision avoidance system for mounting on a vehicle comprising transceiver circuitry including a microprocessor, a memory having stored therein non-transitory instructions for programming the microprocessor, a visual indicator, an audio indicator, a user interface including a display screen and navigation buttons, an RF transceiver with antenna, and a power supply; said transceiver circuitry configured and controlled by the non-transitory instructions stored in memory to form a vehicle group and to warn users of the vehicles when their vehicles or non-group vehicles are closing in on each other to avoid a collision, and to monitor group integrity by way of alert(s) when a group member is outside a preselected proximity perimeter created around the vehicle group.

8. A method for group monitoring and collision avoidance comprising the steps of mounting a transceiver on each of a plurality of vehicles, configuring the transceivers to form the plurality of vehicles and their users into a group, to establish a proximity perimeter around the group as it travels, and to alert the users of the vehicles of other transceivers that are within a defined proximity perimeter to avoid a collision, and to track each member of the group to be constantly aware if all members of the group are within the proximity perimeter.

9. A method for group monitoring and collision avoidance comprising the steps of installing on a vehicle transceiver circuitry including a microprocessor, a memory having stored therein non-transitory instructions for programming the microprocessor, a visual indicator, an audio indicator, a user interface including a display screen and navigation buttons, an RF transceiver with antenna, and a power supply; configuring and controlling said transceiver circuitry by the non-transitory instructions stored in memory for enabling a user of the transceiver to enter data into the memory by interacting with the user interface via the display screen and the navigation buttons, for enabling the transceiver to communicate with other like transceivers mounted on similar vehicles to form a vehicle group, for establishing and monitoring a proximity perimeter about the formed group of vehicles as the vehicles and their users travel, for group monitoring and for initiating visual and audio alerts to avoid a collision in the event that a non-group vehicle has been detected as having penetrated the proximity perimeter and is closing in on at least one vehicle of the group.

10. The method for group monitoring and collision avoidance according to claim 9 further including the steps of detecting a member of the group who has passed beyond the proximity perimeter, and providing a visual alert to the remaining group members still within the proximity perimeter.

11. The method for group monitoring and collision avoidance according to claim 10 further including the step of providing a visual alert indicative of the distance the member of the group has passed beyond the proximity perimeter.

12. The method for group monitoring and collision avoidance according to claim 10 further including the step of providing a visual alert indicative of the direction the member of the group that has passed beyond the proximity perimeter is relative to the remaining group members still within the proximity perimeter.

13. The method for group monitoring and collision avoidance according to claim 10 including the further step of providing a visual alert indicative of the GPS location of the member of the group that has passed beyond the proximity perimeter relative to the remaining group members still within the proximity perimeter.

14. The method for group monitoring and collision avoidance according to claim 8 including the further step of configuring and controlling said transceiver circuitry by the non-transitory instructions stored in memory for establishing and monitoring an inner proximity perimeter about the formed group of vehicles as the vehicles and their users travel, and an outer proximity perimeter about the formed group of vehicles as the vehicles and their users travel.

* * * * *